United States Patent [19]

DeLisle et al.

[11] 4,421,110

[45] Dec. 20, 1983

[54] MASSAGE AND EXERCISE MAT

[75] Inventors: Richard W. DeLisle, 90 Washington St., Leominster, Mass. 01453; Conrad Leblanc, Leominster, Mass.

[73] Assignee: Richard W. DeLisle, Leominster, Mass.

[21] Appl. No.: 269,685

[22] Filed: Jun. 2, 1981

[51] Int. Cl.[3] ..... A61H 7/00

[52] U.S. Cl. ..... 128/60

[58] Field of Search ..... 128/60, 61, 57, 62 R; 272/96, 93, 126, 70

[56] References Cited

U.S. PATENT DOCUMENTS

| | | | |
|---|---|---|---|
| 655,490 | 8/1900 | Hollem | 128/60 |
| 1,382,436 | 6/1921 | Malm | 128/62 R |
| 1,491,016 | 4/1924 | McGowan | 128/62 R |
| 1,697,957 | 1/1929 | Kelly | 128/60 |
| 2,688,960 | 9/1954 | Fischer | 128/57 |
| 2,820,454 | 1/1958 | Wright | 272/96 |
| 2,836,175 | 5/1958 | Nakayama | 128/60 |
| 3,100,483 | 8/1963 | Altmeyer | 128/25 B |
| 3,107,665 | 10/1963 | Nordgren | 128/60 |
| 3,645,256 | 2/1972 | Morrison | 128/57 |
| 3,645,257 | 2/1972 | Nakayama | 128/60 |

*Primary Examiner*—Richard J. Johnson

[57] ABSTRACT

A one piece massage and exercise mat made of a resilient material comprising an elongate base having two rows of opposed massage elements projecting upwardly from said base and positioned on said base to longitudinally and transversely bracket the vertebrae of the spinal column of a human being. The mat of this invention being adapted to effect masssage and exercise of the muscles and nerves along the spinal column by the user without assistance.

2 Claims, 4 Drawing Figures

MASSAGE AND EXERCISE MAT

BACKGROUND OF THE INVENTION

Innumerable devices have been proposed in the prior art to relieve pain and fatigue in the human body and to produce curative effects by stimulation of the muscles and skin using massage techniques. These devices range from hand held brushes to mats which the user walks upon. Generally these prior art devices comprise a base element from which projects massage elements in the form of knobs, lumps, teeth or bristles arranged in various manners and generally without detailed consideration of the anatomy of the human body. Exemplary of the prior art are the following U.S. Patents:

U.S. Pat. No. 2,836,175 and 3,645,257 disclose hand held massage devices comprising a base and a number of projecting massage elements having freely rotatable spherical bodies which are intended to improve the efficiency of the massage because of their rotational ability when the device is moved across the area of treatment. The patentee discloses that the patient may treat himself by placing the device on a bed, lie upon it and move his body in the desired directions to effect a massage treatment.

U.S. Pat. No. 3,107,665 discloses a hand held massage device having rows of metal teeth positioned on and projecting from a base. A space is provided in the center of the device between the rows of teeth to allow the device to be moved along the spinal column without striking it with the projecting teeth. The teeth of the device are made of metal in order to conduct heat from the body.

U.S. Pat. No. 3,100,483 discloses a foot exerciser mat. The mat is made of a soft material with numerous knobs projecting from the base. The user places his feet on the knobs and kneads them against the knobs to massage the feet.

U.S. Pat. No. 1,697,957, an abdominal exerciser comprising a hard base with a number of protuberance projecting from it. The device is intended to be laid upon and the patient moves back and forth to effect massage of the abdomen.

Several massage devices have been disclosed in the prior art which incorporate straps that assist in holding these devices in the hand. Exemplary of these devices are U.S. Pat. No. 1,382,436 and 1,491,016.

SUMMARY OF THE INVENTION

This invention is that of a massage and exercise device designed to massage and exercise the muscles and nerves along the spinal column of a human being. It comprises a one-piece mat made of a resilient material, having an elongate base and two opposed rows of massage elements and projecting upwardly from it. The two rows of massage elements are positioned on the base and are transversely spaced a distance apart sufficient to proximately bracket the spinal column of a human being so that the user can position one row along the right side of the spinal column and the other row along the left side. Within each row, the massage elements are longitudinally spaced apart, a distance to proximately bracket the vertebrae of the spinal column.

In order to effect desired massage and exercise, the user places the mat on a firm surface and lies upon the mat so that the two rows of massage elements proximately bracket the spinal column and the massage elements are positioned between the vertebrae. The user then effects the desired massage by rocking transversely and longitudinally across the mat. If desired, the user can exercise and massage other parts of the body in a similar manner.

The massage and exercise mat of this invention is designed to provide a method whereby a person can without assistance, massage the muscles along the spinal column and the nerves exiting between the vertebrae to relieve tension, pain and improve overall health.

DETAILED DESCRIPTION OF THE PREFERRED EMBODIMENTS

Figure 1:
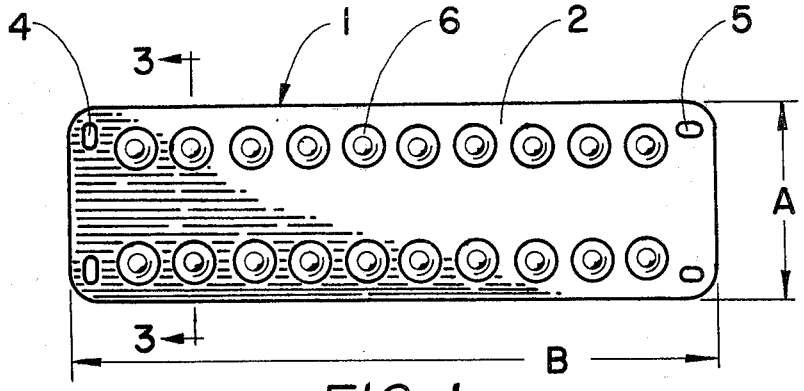
FIG. 1 is top view of the mat.
Figure 2:
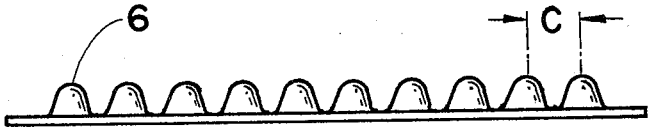
FIG. 2 is a front view of the mat.
Figure 3:
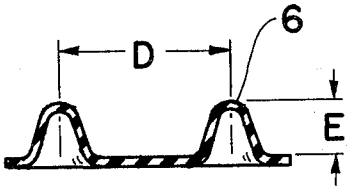
FIG. 3 is a sectional view through the plane of FIG. 2.
Figure 4:
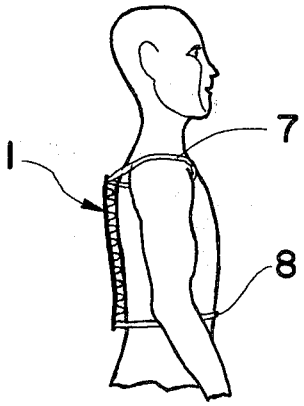
FIG. 4 is an illustration of a person wearing the mat attached to the body by shoulder and waist straps.

FIG. 1 to FIG. 3 illustrate the massage and exercise mat of the invention in top, front and sectional view respectively. FIG. 4 illustrates a person wearing the massage and exercise mat of the invention.

Referring first to FIG. 1, the massage and exercise mat 1 is illustrated in top view. The mat 1 is made of a flexible, resilient material and it comprises an elongate base 2 having two opposed rows of massage elements 6 positioned longitudinally along the major axis of the base 2 or along its length, dimension B. The length of mat 1, dimension B is preferably approximately 18 inches, however, it may be varied depending upon the length of the user's spinal column and is adapted to extend substantially from a user's shoulders to his waist as shown in FIG. 4. The width of the mat 1 is preferably approximately 5 inches wide, dimension A; it likewise can be varied depending on the size of the user.

Located at each end of the mat 1 are a pair of holes 4 and 5 adapted to receive straps adapted to attach to mat 1 to the user's body as illustrated in FIG. 4. The pair of holes 5 are positioned to receive a strap 8 shown in FIG. 4 and designed to be passed around the waist of the user. The pair of holes 4 at the top of the mat 1 are each adapted to receive a loop type strap 7 (only one shown), which the user passes each arm through to secure the mat 1 in place against the back. These straps 7 and 8 allow the user to position the mat 1 against the body for use in the standing or sitting position.

FIG. 2 shows a front view of the mat 1. The massage elements 6 are positioned longitudinally apart a distance, dimension C, to proximately bracket the vertebrae of the user's spinal column; preferably this distance is 1.5 inches although it may be varied to suit the size and spacing of the user's vertebrae.

FIG. 3 illustrates a sectional view through the plane 3—3 of FIG. 2. The massage elements 6 are spaced a distance, dimension D to proximately bracket the spinal column of the user so that each row of massage elements may be positioned along each side of the user's spinal column; preferably this distance, dimension D is approximately 3 inches. The massage elements are of sufficient height to provide firm contact with and penetration into the user's flesh so that massage of the muscles and nerves along the spinal column may be effected; the height, dimension E is preferably 1 to 1.5 inches for the average person.

Although the term "preferred" has been used in this description, it should be realized that the described dimensions may be varied without departing from the scope of this invention and the location of the massage elements 6 on the mat 1 may be varied to adapt to the size of the user's body.

The term "massage elements" as used in this description are knob-like projections adapted to provide a kneading and massage effect to the muscles, nerves and tissue of the user. Preferably they are generally frusto-conical in shape with a hemispherical top and designed to reproduce the effect obtained with the fingers of the hand. As shown in FIG. 1, ten massage elements 6 are located in each row which are parallel to each other. However, it is contemplated that the beneficial effects of this invention could be obtained with a device having two staggered rows of massage elements wherein one element is alternately eliminated from each row.

The massage elements 6 shown in FIG. 3 are approximately 1 inch in diameter at the point of juncture with the base 2. They rise to a height of 1 to 1½ inches with a hemispherical apex approximately ½ to ¾ of an inch in diameter. Also shown in FIG. 3 is the fact that massage elements are integral with the base. This construction, coupled with the flexible resilient material of the mat allows the massage elements to pivot back and forth as the user exercises, thus keeping the massage elements in contact with specific points on the body. As shown in FIG. 3, the massage elements are hollow. This construction is preferred because it tends to enhance the ability of the elements to be rigid enough to effect stimulation of the user's muscles but flexible enough to pivot as the user's body passes back and forth over the elements. A second advantage is a reduction in cost in the manufacture of the product. The base 2 of the mat is of a thickness of approximately ½ to 3/32 of an inch, preferably about 3/32 of an inch.

The massage and exercise mat of this invention may be fabricated by conventional plastic and elastomer fabrication techniques e.g., injection molding, compression molding, casting or extrusion processes. It is made of a resilient flexible material e.g., natural rubber, synthetic rubber, or plastics such as polyethylene, polypropylene and blends of such material with other compounds to produce the correct balance of firmness, flexibility and resilience. It has been found that the mat of this invention can be prepared by injection molding a styrene-butadiene-styrene thermoplastic rubber having a Shore A hardness of 62 (ASTM D-2240). This product is available under the trademark Kraton 2103, Shell Chemical Company. A material with a Shore A hardness of 45–85 should provide sufficient hardness and flexibility for most individuals.

The massage and exercise device of this invention may be used in many ways to stimulate the muscles and nerves of the body of the user without assistance by another. Its design is primarily intended to massage and exercise the muscles and nerves along the spinal column. Generally positioned along the spinal column and between the vertebrae are certain points where the nerves of the sympathetic and parasympathetic nervous system exit the spine. These points are termed "MU" points in the Chinese medical practice of acupuncture or acupressure and are very similar to those of the Meric System of the Chiropractic profession. Stimulation of these points which run paravertably along the spinal column have a calming effect on the body and can relieve pain and tension in related areas.

The patient effects massage of muscles along the spine and the nerves at the "MU" points by placing the mat of this invention on a firm surface and lies upon it so that the massage elements 6 bracket the spinal column and the vertebrae while at the same time are positioned to contact with the back muscles. The user rocks his body back and forth across and/or along the mat and effects massage of the muscles and nerves in the effected areas. The stimulation of the muscles increases blood circulation resulting in improved lymphatic drainage and removal of waste products from the tissue. Stimulation the the "MU" points is believed to help balance the nervous system which results in a reduction in tension and a reduction in pain in the effected area. It is also believed that stimulation of the nerves help to strengthen organs and systems of the body.

Alternatively the user may strap the mat 1 of this invention to his back by use of the shoulder 7 and waist 8 straps as shown in FIG. 4. This allows use of the massage and exercise mat in the standing or sitting position. For example a driver can use the mat to stimulate muscles and nerves while driving from point to point.

In order to stimulate the parasympathetic nerves the user can place the mat transversely across the pelvic region and sit upon it. Rocking back and forth will stimulate those nerves exiting the spinal column in the pelvic area. Stimulation of these nerves is believed to aid in balancing the nervous system to improve overall health.

The use of the mat of this invention is not intended to be a cure for any disease nor is its indiscriminate use recommended. Over use of any stimulation to the body can cause problems. It is not intended as a substitute for a physician or health care provider. Users of this inventiion are admonished to use it with discretion and if any symptom persists, a physician should be consulted.

Although this invention has been described in terms of a specific embodiment, it should be understood that this was done for illustrative purposes and alternative embodiments will become apparent to those skilled in the art. For instance, an additional row or rows of massage elements may be positioned on the mat to effect a wider area of massage and exercise. Accordingly this and other modifications are contemplated without departing from the described invention.

What I claim is:

1. A one piece massage and exercise mat adapted for use by a human being to simultaneously exercise without assistance, the muscles and nerves positioned along and exiting the spinal column of said user, consisting essentially of an elongate base adapted to extend substantially from a users shoulders to his waist and two opposed rows of massage elements made of a resilient moldable material having a Shore A hardness of from about 45 to about 85, said massage elements projecting upwardly from said base and integral therewith, said massage elements transversely positioned on said base to proximately bracket the spinal column of said user and adapted to be juxta positioned by the user, longitudinally along the spinal column of said user, said massage elements being longitudinally spaced to proximately bracket the vertebrae of the spinal column of said user and adapted to be positioned by said user proximately between said vertebrae.

2. The massage and exercise mat of claim 1 wherein said base is provided with means for attaching said mat to the user's body.

* * * * *